US007095391B2

(12) United States Patent
Lee

(10) Patent No.: US 7,095,391 B2
(45) Date of Patent: Aug. 22, 2006

(54) LOW POWER LCD

(75) Inventor: Hyong-Gon Lee, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 668 days.

(21) Appl. No.: 09/934,590

(22) Filed: Aug. 23, 2001

(65) Prior Publication Data

US 2002/0075252 A1 Jun. 20, 2002

(30) Foreign Application Priority Data

Dec. 20, 2000 (KR) ..... 2000-79350

(51) Int. Cl.
*G09G 3/36* (2006.01)

(52) U.S. Cl. ..... 345/87; 345/211

(58) Field of Classification Search ..... 345/211, 345/204, 205–206, 87–90, 98–100; 349/143, 349/149

See application file for complete search history.

(56) References Cited

U.S. PATENT DOCUMENTS 5,471,225 A * 11/1995 Parks ..... 345/98
5,712,652 A * 1/1998 Sato et al. ..... 345/90
5,945,972 A * 8/1999 Okumura et al. ..... 345/98
5,977,940 A * 11/1999 Akiyama et al. ..... 345/94
6,005,558 A * 12/1999 Hudson et al. ..... 345/204
6,636,194 B1 * 10/2003 Ishii ..... 345/98

* cited by examiner

*Primary Examiner*—Richard Hjerpe
*Assistant Examiner*—Abbas Abdulselam
(74) *Attorney, Agent, or Firm*—F. Chau & Associates, LLC

(57) ABSTRACT

Disclosed is a low power LCD which comprises a scan signal line for supplying scanning signals to pixels configuring an LCD panel; a source signal line for supplying image signals to pixels configuring an LCD panel; a pixel switch for outputting the image signals to a third electrode from a first electrode connected to the source signal line or stopping the same according to a high or low voltage state of a second electrode connected to the scan signal line; a power unit for respectively supplying first and second powers to all pixels from the outside of a pixel area of the LCD panel; a control signal line unit respectively including a first control signal line for transmitting a first control signal to all pixels from the outside of the pixel area of the LCD panel, and a second control signal line for transmitting a second control signal to all pixels from the outside of the pixel area of the LCD panel; a liquid crystal unit for transmitting or blocking light according to voltage difference between the image signals and the second power; and a memory cell unit for receiving the first control signal and the second control signal from the control signal line unit, and when the first control signal is in low state and the second control signal is in high state, transmitting an operation mode image signal output by the third electrode of the pixel switch to the liquid crystal unit, and when the first control signal is in high state, transmitting either a still mode image signal output by the third electrode of the pixel switch or its inverting signal to the liquid crystal unit as the second control signal periodically repeats the low and high states according to characteristics of the LCD panel.

18 Claims, 5 Drawing Sheets

LOW POWER LCD

BACKGROUND OF THE INVENTION (a) Field of the Invention

The present invention relates to a liquid crystal display (LCD). More specifically, the present invention relates to a pixel forming circuit for driving an LCD with low power.

(b) Description of the Related Art

An LCD generally comprises an LCD unit including an LCD panel having liquid crystal cells between two glass substrates in a matrix pattern, a backlight unit provided on the rear side of the LCD panel, a printed circuit board (PCB) unit for driving the LCD panel, and a case for protecting and integrating the units. Here, the PCB unit is a driving circuit for receiving red R, green G and blue B image data and synchronization signals, processing the same, and providing image data, scanning signals and timing control signals to the LCD panel so that the LCD panel normally displays computer images, television image and other images. The PCB unit comprises a plurality of PCBs and a plurality of flexible printed cables (FPC) for transmitting signals between the PCBs.

Referring to FIG. 1 showing a schematic diagram of a conventional LCD, a PCB unit of relative low resolution such as SVGA (600×800) for driving the LCD panel 40 on the rear side of the LCD panel 40 comprises a main PCB 10 for receiving the R, G and B image data and the synchronization signals, processing the same using a timing controller that is a customized integrated circuit (IC) of a flat pin grid array (FPGA) type, and processing and generating the image data and various control signals; a scan driver PCB 20 having a scan driver IC tape automated bond (TAB) that provides scanning signals to scan signal lines according to scan driver control signals provided by the main PCB 10; and a source driver PCB 30 having a source driver IC TAB that receives the image data and the control signals processed and provided by the main PCB 10, and provides the same to the LCD panel 40.

Referring to FIG. 2, a pixel configuration on the LCD panel comprises a scan signal line 21 for transmitting the scanning signals provided by the scan driver IC TAB of the scan driver PCB 20, a source signal line 31 for transmitting the image signals provided by the source driver IC TAB of the source driver PCB 30, liquid crystal 42, a metal oxide semiconductor (MOS) type thin film transistor (TFT) 41 for receiving the scanning signals and the image signals and transmitting the same to the liquid crystal 42 and a storage capacitor 43. At this time, the TFT 41 is turned off when receiving the scanning signal via a gate electrode, and receives the image signals from the source signal line 31 via a source electrode and transmits the same to the liquid crystal 42 and the storage capacitor 43 when the scanning signal is in high state. Next, when the scanning signal is in low state, the image signals stored in the liquid crystal 42 and the storage capacitor 43 are maintained during a frame set for respective resolutions.

However, the consuming power for driving the LCD adapted to notebook computers, portable personal digital assistants (PDA) and reflective PDAs ranges from several tens to several hundred watts [W] according to the size of the LCD panel. This power becomes a problem when a user goes out and uses the battery for a long time. Therefore, increased lifetime of the battery by low power consumption becomes main factor in business competitiveness.

SUMMARY OF THE INVENTION

It is an object of the present invention to provide a pixel configuration circuit and a method for saving power necessary for driving the LCD.

In one aspect of the present invention, a low power LCD comprises: a scan signal line for supplying scanning signals to pixels configuring an LCD panel; a source signal line for supplying image signals to pixels configuring an LCD panel; a pixel switch for outputting the image signals to a third electrode from a first electrode connected to the source signal line, or stopping the same according to a high or low voltage state of a second electrode connected to the scan signal line; a power unit for respectively supplying first and second powers to all pixels from the outside of a pixel area of the LCD panel; a control signal line unit respectively including a first control signal line for transmitting a first control signal to all pixels from the outside of the pixel area of the LCD panel, and a second control signal line for transmitting a second control signal to all pixels from the outside of the pixel area of the LCD panel; a liquid crystal unit for penetrating or stopping light according to a difference between an electrode that receives image signals and the second power; and a memory cell unit for receiving the first and second control signals from the control signal line unit, and when the first control signal is in low state and the second control signal is in high state, transmitting an operation mode image signal output by the third electrode of the pixel switch to the liquid crystal unit, and when the first control signal is in high state, transmitting either a still mode image signal output by the third electrode of the pixel switch or its inverting signal to the liquid crystal unit as the second control signal periodically repeats the low and high states according to characteristics of the LCD panel.

The memory cell unit comprises: a first inverter circuit having an nTFT and a pTFT, a drain electrode of the nTFT being connected to that of the pTFT, and gate electrodes being connected to the third electrode of the pixel switch; a second inverter circuit having an nTFT and a pTFT, drain electrodes of the nTFT and pTFT being connected to the third electrode of the pixel switch, and gate electrodes being connected to the drain electrodes of the first inverter circuit; a push nTFT having a drain electrode connected to the first power, a source electrode connected to source electrodes of the pTFTs of the first and second inverter circuits, and a gate electrode connected to the first control signal line; a pull nTFT having a source electrode connected to the second power, a drain electrode connected to source electrodes of the nTFTs of the first and second inverter circuits, and a gate electrode connected to the first control signal line; an operation nTFT having a gate electrode connected to the second control signal line, and source and drain electrodes connected between the third electrode of the pixel switch and the liquid crystal unit; and a still pTFT having a gate electrode connected to the second control signal line, and source and drain electrodes connected between the drain electrode of the first inverter circuit and the liquid crystal unit.

The level shift unit comprises: a third inverter circuit having an nTFT and a pTFT, a drain electrode of the nTFT being connected to that of the pTFT, gate electrodes being connected to the second control signal line, a source electrode of the pTFT being connected to the second power, and a source electrode of the nTFT being connected to the third power; and a level-up pTFT having a gate electrode connected to a drain electrode of the third inverter circuit, a source electrode connected to the second power, and a drain electrode connected to the second control signal line.

In another aspect of the present invention, in a liquid crystal display (LCD) panel driving method for a pixel switch that receives scanning signals and image signals from scanning signal lines and source signal lines to output the image signals to a memory cell unit that is operated by first and second control signals or stops the image signals to display the same, an LCD driving method comprises the memory cell unit transmitting operation mode image signals output by the pixel switch to liquid crystal and displaying the same when the first control signal is in low state and the second control signal is in high state; transmitting either a still mode image signal output by a third electrode of the pixel switch or its inverting signal to the liquid crystal as the second control signal periodically repeats low and high states to fit characteristics of an LCD panel when the first control signal is in high state; and transmitting respective control signals sequentially delayed by a buffer circuit to a corresponding pixel area when the pixel area of the LCD panel is divided into at least two portions, in either a horizontal or vertical direction.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by illustrating the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 3:
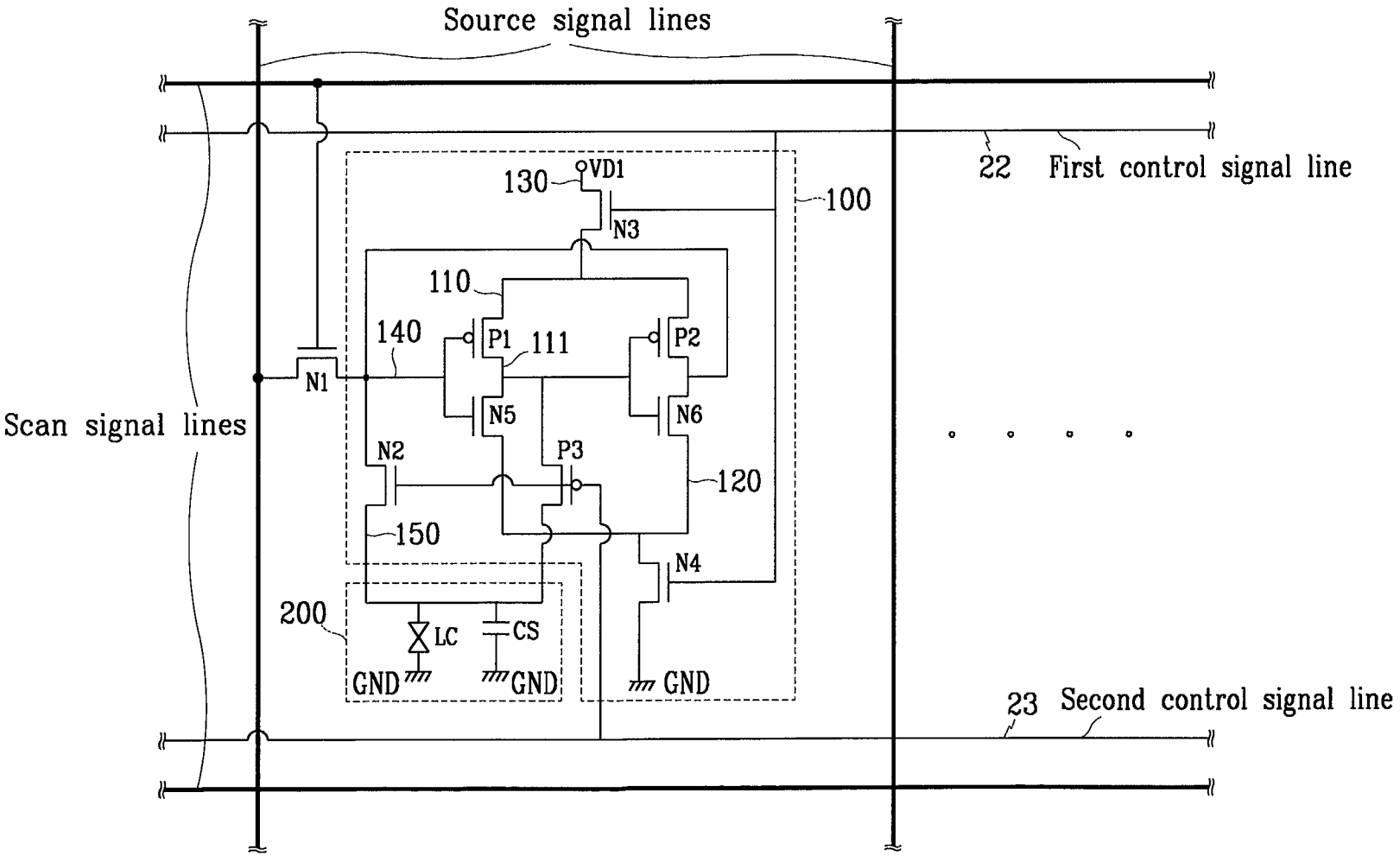
FIG. 3 shows a pixel circuit for configuring an LCD panel of a low power LCD according to a first preferred embodiment of the present invention.

FIG. 3 shows a pixel circuit for configuring an LCD panel of a low power LCD according to a first preferred embodiment of the present invention.

As shown, the pixel circuit comprises a pixel switch N1, powers VD1 and GND, a control signal line unit 22 and 23, a liquid crystal unit 200 and a memory cell unit 100 between the scan signal lines and source signal lines provided on the matrix type LCD panel.

Like the conventional LCD panel, the scan signal lines supply the scanning signals to the pixels that configure the LCD panel, and the source signal lines supply the image signals to the pixels that configure the LCD panel.

The pixel switch N1 outputs the image signals to a third electrode 140 from a first electrode connected to the source signal line or stops the same according to high or low states of the voltage of a second electrode connected to the scan signal line.

Figure 1:
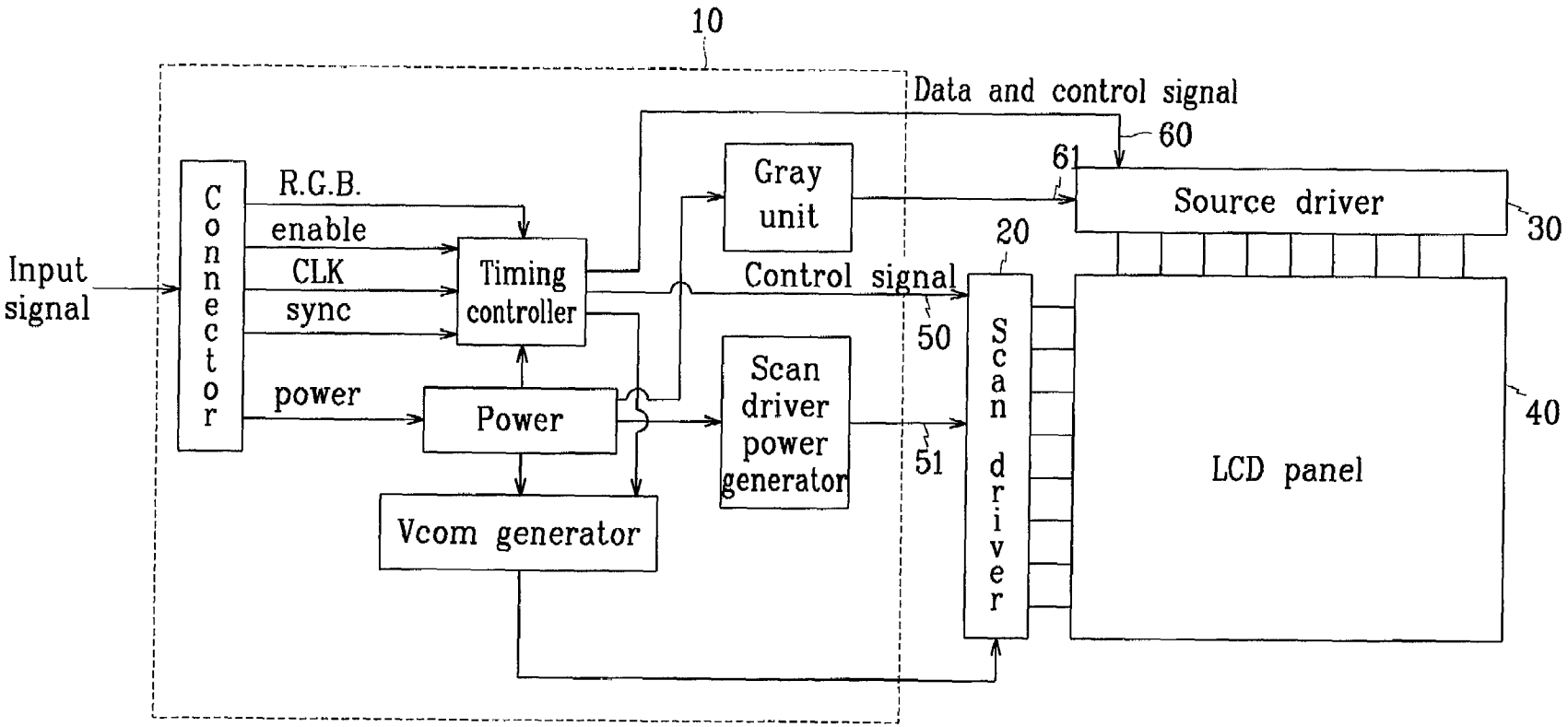
FIG. 1 (Prior art)
FIG. 1 shows a conventional circuit diagram of the LCD.

The powers VD1 and GND individually transmit the first power VD1 and the second power GND to all the pixels from the outside pixel area of the LCD panel. Here, the second power GND conventionally indicates ground, but is not restricted to ground. The second power GND can be any DC voltage according to the first power VD1, and particularly, the second power GND supplied to the liquid crystal unit 200 can be an AC signal for implementing line or dot inversion processes by supplying the Vcom signal generated by the Vcom generator as shown in FIG. 1 via a separate power supply line.

The control signal line unit comprises a first control signal line 22 for transmitting the first control signal to all the pixels from the outside of the pixel area of the LCD panel, and a second control signal line 23 for transmitting the second control signal to all the pixels from the outside of the pixel area of the LCD panel.

The liquid crystal unit 200 transmits or blocks the light according to a voltage difference between an electrode 150 and the second power GND. The liquid crystal unit 200 generally comprises a liquid crystal LC and a storage capacitor CS, and the storage capacitor CS is not always needed.

The memory cell unit 100 receives the first and second control signals from the first control signal line 22 and the second control signal line 23. When the first control signal is in low state and the second control signal is in high state, operation mode image signals output by the third electrode of the pixel switch N1 are sent to the liquid crystal unit 200. When the first control signal is in high state, the second control signal repeats the low state and the high state according to characteristics of the LCD panel, and hence the memory cell unit 100 transmits either a still mode image signal output by the third electrode 140 of the pixel switch or its inverting signal to the liquid crystal unit 200.

The memory cell unit 100 comprises a first inverter circuit P1 and N5, a second inverter circuit P2 and N6, a push nTFT N3, a pull nTFT N4, an operation nTFT N2 and a still pTFT P3.

In the first inverter circuit P1 and N5, drain electrodes 111 of the nTFT N5 and pTFT P1 are connected, and gate electrodes are connected to the third electrode 140 of the pixel switch N1.

In the second inverter circuit P2 and N6, drain electrodes of the nTFT N6 and pTFT P2 are connected to the third electrode 140 of the pixel switch N1, and gate electrodes are connected to the drain electrode 111 of the first inverter circuit P1 and N5.

In the push nTFT N3, a drain electrode is connected to the first power VD1 130, and a source electrode is connected to source electrodes 110 of the pTFTs P1 and P2 of the first and second inverter circuits, and a gate electrode is connected to the first control signal line 22.

In the pull nTFT N4, a source electrode is connected to the second power GND, and a drain electrode is connected to source electrodes 120 of the nTFTs N5 and N6 of the first and second inverter circuits, and a gate electrode is connected to the first control signal line 22.

In the operation nTFT N2, a gate electrode is connected to the second control signal line 23, and remaining two electrodes are connected between the third electrode 140 of the pixel switch N1 and the liquid crystal unit 200.

In the still pTFT P3, a gate electrode is connected to the second control signal line 23, and remaining two electrodes are connected between the drain electrode 111 of the first inverter circuit P1 and N5 and the liquid crystal unit 200.

A detailed operation of the low power LCD according to the first preferred embodiment of the present invention will now be described.

First, in the normal operation mode, when a high state voltage is supplied to the scan signal line and a corresponding operation mode image signal is supplied to the source signal line according to a frame period of a resolution, the high state voltage is supplied to the gate electrode that is the second electrode of the pixel switch N1 to be turned on, and at this time, image signals are transmitted to the third electrode 140 from the first electrode connected to the source signal line. At this time, since the second control signal transmitted via the second control signal line 23 is in high state and the first control signal transmitted via the first control signal line 22 is in low state, the push nTFT N3, pull nTFT N4 and still pTFT P3 are turned off, and therefore, the memory cell unit 100 becomes floating from the powers VD1 and GND and is not operated, and the operation nTFT N2 becomes turned on, and hence, the image signals transmitted to the third electrode 140 of the pixel switch N1 are transmitted to the liquid crystal unit 200. Here, the liquid crystal unit 200 transmits or blocks the light according to the voltage difference between an electrode 150 and the second power GND, so as to display moving pictures.

Next, in the case of the still mode operation by using a still mode key or a still mode switch to be controlled at the outside of the LCD panel, when the high state voltage is supplied to the scan signal line and corresponding still mode image signal is supplied to the source signal line according to the frame period depending on the resolutions, the high state voltage is supplied to the gate electrode that is the second electrode of the pixel switch N1 to be turned on, and at this time, the image signals are transmitted to the third electrode 140 from the first electrode connected to the source signal line. At this time, when the still mode image signals of a full screen corresponding to a single frame are provided, the scan driver 20 and the source driver 30 of FIG. 2 become disabled until switching to the operation mode, and no signal is provided to the scan signal lines and source signal lines.

Here, the still mode image signal has a gray number different from that of the full-color operation mode image signal, and either a high state or a low state digital signal is supplied to each pixel. A high state or a low state signal is latched to the memory cell unit 100. Since either a high state or a low state of the digital image signal of the still mode image signal at this time is provided to the respective pixels of the red, green and blue, eight kinds of color are implemented by the two kinds of color implemented by each pixel.

At this time, since the first control signal transmitted via the first control signal line 22 becomes high state and the push nTFT N3 and the pull nTFT N4 become turned on, the memory cell unit 100 receives the first power VD1 and the second power GND from the powers VD1 and GND and then operates. As the second control signal transmitted via the second control signal line 23 periodically repeats the high state and the low state according to the characteristics of the LCD panel, the still pTFT P3 and the operation nTFT N2 periodically repeat on/off states according to the characteristics of the LCD panel, and then transmits either the still mode image signals transmitted to the third electrode 140 of the pixel switch N1 or corresponding inverting signals from the drain electrodes 111 generated by the first inverter circuit P1 and N5 to the liquid crystal unit 200. Here, the periodical repetition of the second control signal is, as described above, when the second power GND supplied to the liquid crystal unit 200 provides AC signals for implementing line inversion or dot inversion processes, generated by the conventional Vcom generator of FIG. 1 according to the resolution of the LCD panel via an additional power supply line, to invert the image signals transmitted to the liquid crystal unit 200 with a period identical with that of the Vcom signal, and remove conventional flickers.

Figure 2:
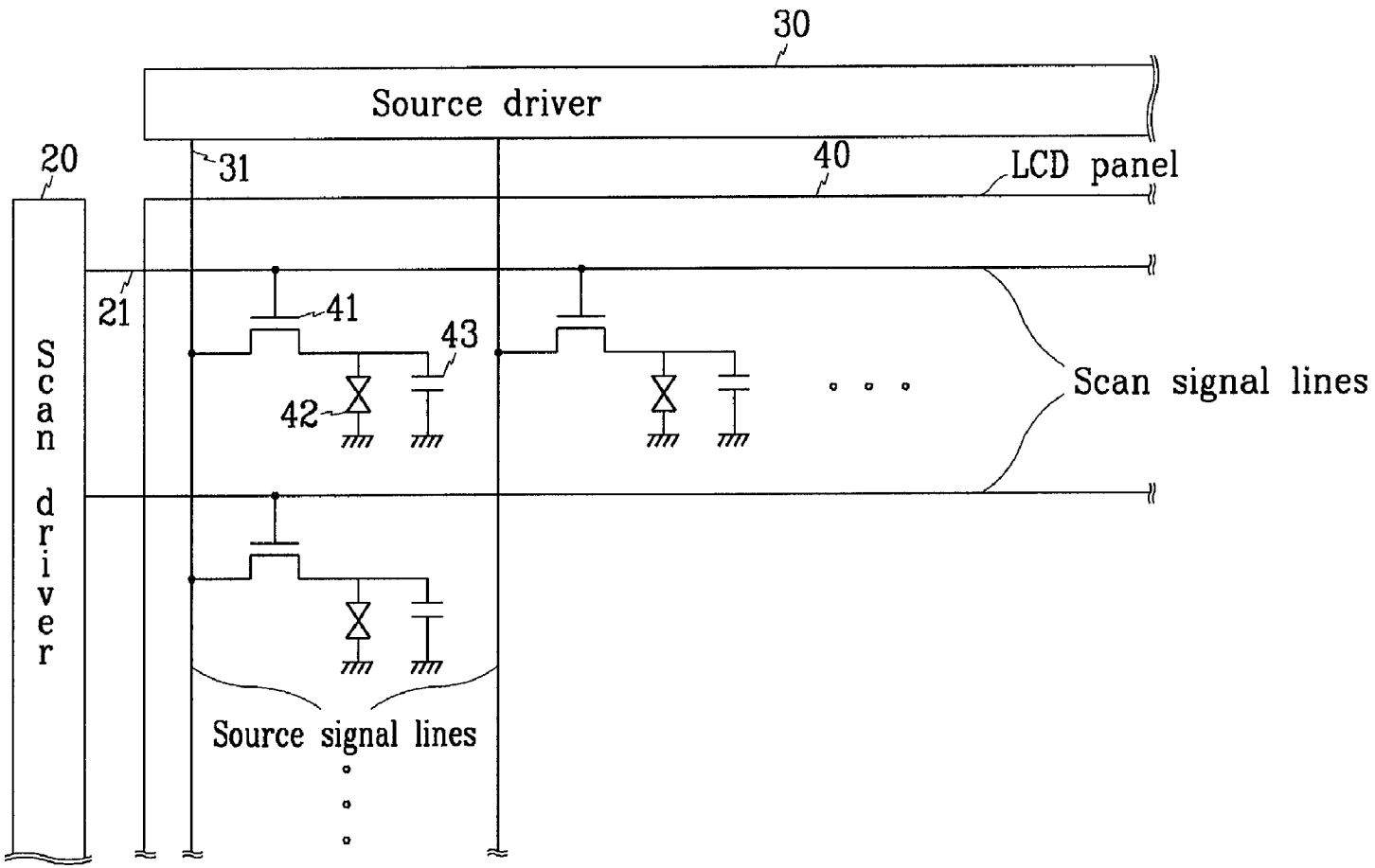
FIG.2(Prior art)
FIG. 2 shows a schematic diagram of a conventional pixel configuration of the LCD.

Next, the liquid crystal unit 200 transmits or blocks the light according to a voltage difference between an electrode 150 for receiving the still mode image signals and the second power GND so as to display still images. At this time, in the still mode operation, the scan driver 20 and the source driver 30 of FIG. 2 are disabled until switching to the operation mode, and since no signal is provided to the scan signal lines and source signal lines, and the image information is stored in the pixel according to the operation of the memory cell unit 300, the power consumed by the LCD panel is greatly reduced until switching to the operation mode.

Figure 4:
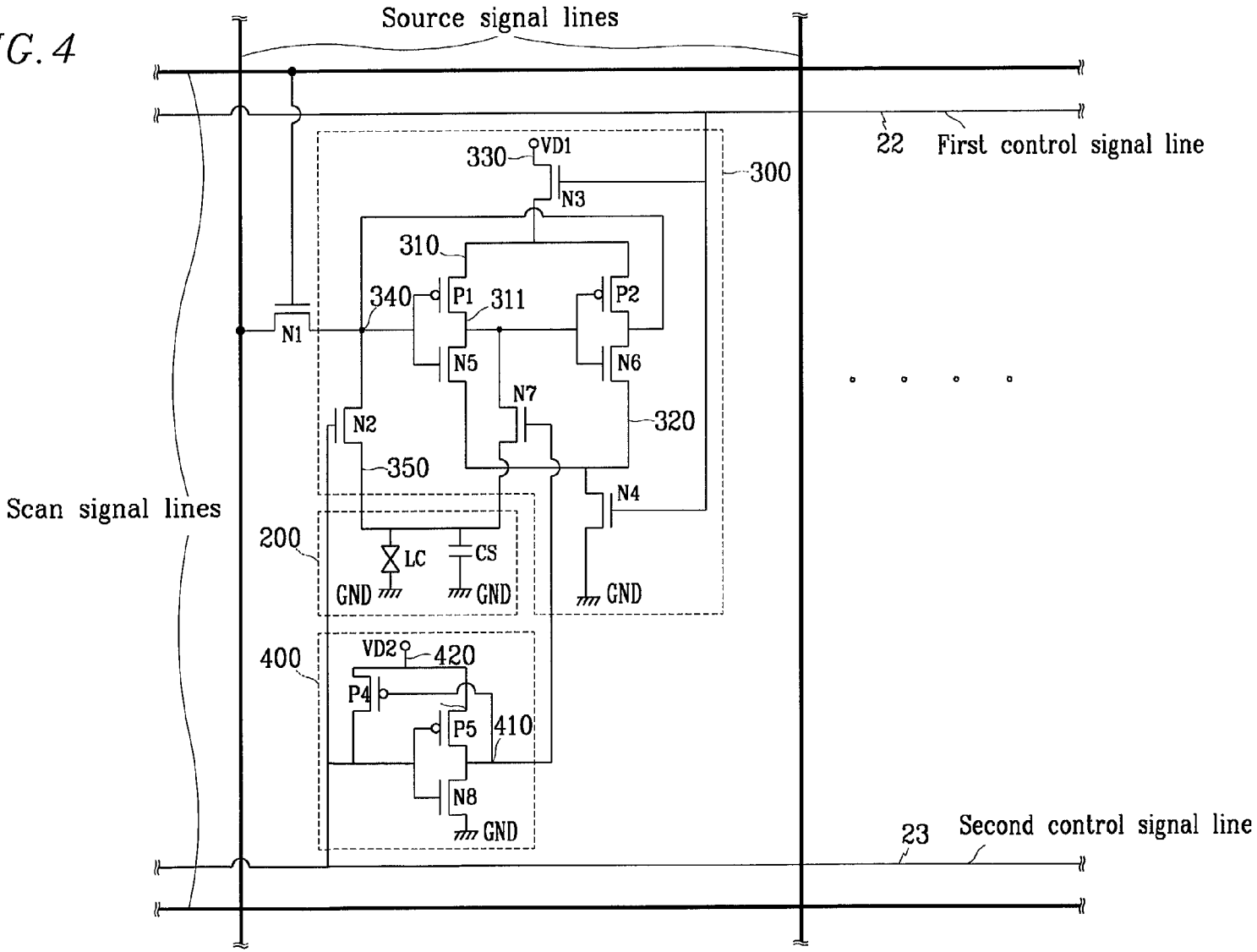
FIG. 4 shows a pixel circuit for configuring an LCD panel of a low power LCD according to a second preferred embodiment of the present invention.

FIG. 4 shows a pixel circuit for configuring an LCD panel of a low power LCD according to a second preferred embodiment of the present invention.

As shown, the pixel circuit for configuring an LCD panel of a low power LCD according to a second preferred embodiment comprises a pixel switch N1, powers VD1, VD2 and GND, a control signal line unit 22 and 23, a liquid crystal unit 200, a level shift unit 400 and a memory cell unit 300 between the scan signal lines and source signal lines provided on the matrix type LCD panel.

Like the conventional LCD panel, the scan signal lines supply the scanning signals to the pixels that configure the LCD panel, and the source signal lines supply the image signals to the pixels that configure the LCD panel.

The pixel switch N1 outputs the image signals to a third electrode 140 from a first electrode connected to the source signal line or stops the same according to high or low states of the voltages of a second electrode connected to the scan signal line.

The powers VD1, VD2 and GND respectively transmit the first power VD1, second power VD2 and the third power GND to all the pixels from the outside pixel area of the LCD panel. Here, the third power GND conventionally indicates ground, but is not restricted to ground. The third power GND can be any DC voltage according to the first and second powers VD1 and VD2. Particularly, the third power GND supplied to the liquid crystal unit 200 can be an AC signal for implementing line or dot inversion processes by supplying the Vcom signal generated by the Vcom generator as shown in FIG. 1 via a separate power supply line.

The control signal line unit comprises a first control signal line 22 for transmitting the first control signal to all the pixels from the outside of the pixel area of the LCD panel, and a second control signal line 23 for transmitting the second control signal to all the pixels from the outside of the pixel area of the LCD panel.

The liquid crystal unit 200 transmits or blocks the light according to a voltage difference between an electrode 350 and the third power GND. The liquid crystal unit 200 generally comprises a liquid crystal LC and a storage capacitor CS. The storage capacitor CS is not always necessary.

The level shift 400 receives the second control signal, lifts the high state by as much as the magnitude of the second power VD2, generates an inverting signal, and outputs the same to the memory cell unit 300.

The level shift unit 400 comprises a third inverter circuit P5 and N8, and a level-up pTFT P4.

In the third inverter circuit P5 and N8, drain electrodes 410 of the nTFT N8 and pTFT P5 are connected, gate electrodes are connected to the second control signal line 23, a source electrode 420 of the pTFT P5 is connected to the second power VD2, and a source electrode of the nTFT N8 is connected to the third power GND.

In the level-up pTFT P4, a gate electrode is connected to a drain electrode 410 of the third inverter circuit P5 and N8, a source electrode is connected to the second power VD2 420, and a drain electrode is connected to the second control signal line 23.

The memory cell unit 300 receives the first and second control signals from the first control signal line 22 and the second control signal line 23 and receives an inverting signal of the second control signal output by the level shift unit 400. When the first control signal is in low state and the second control signal is in high state, operation mode image signals output by the third electrode of the pixel switch are transmitted to the liquid crystal unit 200. When the first control signal is in high state and the second control signal repeats the low and high states according to characteristics of the LCD panel, the memory cell unit 300 transmits either a still mode image signal output by the third electrode 340 of the pixel switch or its inverting signal, to the liquid crystal unit 200.

The memory cell unit 300 comprises a first inverter circuit P1 and N5, a second inverter circuit P2 and N6, a push nTFT N3, a pull nTFT N4, an operation nTFT N2 and a still nTFT N7.

In the first inverter circuit P1 and N5, drain electrodes 111 of the nTFT N5 and pTFT P1 are connected, and gate electrodes are connected to the third electrode 340 of the pixel switch.

In the second inverter circuit P2 and N6, drain electrodes of the nTFT N6 and pTFT P2 are connected to the third electrode 340 of the pixel switch, and gate electrodes are connected to the drain electrode 111 of the first inverter circuit P1 and N5.

In the push nTFT N3, a drain electrode is connected to the first power VD1 and 130, and a source electrode is connected to source electrodes 310 of the pTFTs P1 and P2 of the first and second inverter circuits, and a gate electrode is connected to the first control signal line 22.

In the pull nTFT N4, a source electrode is connected to the third power GND, and a drain electrode is connected to source electrodes 320 of the nTFTs N5 and N6 of the first and second inverter circuits, and a gate electrode is connected to the first control signal line 22.

In the operation nTFT N2, a gate electrode is connected to the second control signal line 23, and remaining two electrodes are connected between the third electrode 340 of the pixel switch N1 and the liquid crystal unit 200.

In the still pTFT N7, a gate electrode is connected to receive an inverting signal 410 of the second control signal output by the level shift unit 400, and remaining two electrodes are connected between the drain electrode 311 of the first inverter circuit P1 and N5 and the liquid crystal unit 200.

An operation of the low power LCD according to the second preferred embodiment will be described considering the addition of the level shift unit 400 and the exchange with the still nTFT N7.

First, in the normal operation mode, when a high state voltage is supplied to the scan signal line and a corresponding operation mode image signal is supplied to the source signal line according to a frame period of a resolution, the high state voltage is supplied to the gate electrode that is the second electrode of the pixel switch N1 to be turned on. At this time, image signals are transmitted to the third electrode 340 from the first electrode connected to the source signal line. At this time, since the second control signal transmitted via the second control signal line 23 is in high state and the first control signal transmitted via the first control signal line 22 is in low state, the push nTFT N3, pull nTFT N4 and still pTFT N7 are turned off. Therefore, the memory cell unit 300 floating from the powers VD1, VD2 and GND does not operate. However, the operation nTFT N2 becomes turned on, and hence, the image signals transmitted to the third electrode 340 of the pixel switch N1 are transmitted to the liquid crystal unit 200. Here, the liquid crystal unit 200 transmits or blocks the light according to the voltage difference between an electrode 350 and the third power GND so as to display moving pictures.

Here, the operation nTFT N2 is turned on since the second control signal transmitted by the second control signal line 23 becomes in high state. If the voltage of the second control signal is identical to the image signal, the voltage of the image signal transmitted to the liquid crystal unit 200 via the nTFT N2 is lowered by the amount of the unique threshold voltage for operating nTFT N2. To prevent this, the voltage is increased to the second power VD2 by the level shift unit 400 and is supplied to the gate electrode of the operation nTFT N2. That is, as shown in FIG. 4, for example, in operating the level shift unit 400, if the second control signal is in high state, the output voltage of the third inverter circuit P5 and N8 becomes low. When receiving the low voltage, the level-up pTFT P4 supplies the voltage of the second power VD2 greater than that of the image signal to the gate electrode nTFT N2.

Next, in the still mode operation by using a still mode key or a still mode switch to be controlled at the outside of the LCD panel, when the high state voltage is supplied to the scan signal line and corresponding still mode image signal is supplied to the source signal line according to the frame period depending on the resolutions, the high state voltage is supplied to the gate electrode that is the second electrode of the pixel switch N1 to be turned on. At this time, the image signals are transmitted to the third electrode 340 from the first electrode connected to the source signal line. At this time, when the still mode image signals of a full screen corresponding to a single frame are provided, the scan driver 20 and the source driver 30 of FIG. 2 become disabled until switching to the operation mode, and no signal is provided to the scan signal lines and source signal lines.

Here, the still mode image signal has a gray number different from that of the full-color operation mode image signal, and either a high state or a low state digital signal is supplied to each pixel, and a high state or a low state signal is latched to the memory cell unit 300, and since either a high state or a low state of the digital image signal of the still mode image signal at this time is provided to the respective pixels of the red, green and blue, eight kinds of color are implemented by the two kinds of color implemented by each pixel.

At this time, since the first control signal transmitted via the first control signal line 22 becomes high state and the push nTFT N3 and the pull nTFT N4 become turned on, the memory cell unit 300 receives the first, second and third powers VD1, VD2 and GND and then operates. As the second control signal transmitted via the second control signal line 23 periodically repeats the high and low states according to the characteristics of the LCD panel, the still pTFT P7 and the operation nTFT N2 periodically repeat on/off states according to the characteristics of the LCD panel, and then transmits either the still mode image signals transmitted to the third electrode 340 of the pixel switch N1 or corresponding inverting signals 311 generated by the first inverter circuit P1 and N5 to the liquid crystal unit 200. Here, the periodical repetition of the second control signal is, as described above, when the third power GND supplied to the liquid crystal unit 200 provides AC signals for implementing line inversion or dot inversion processes, generated by the conventional Vcom generator of FIG. 1 according to the resolution of the LCD panel via an additional power supply line, to invert the image signals transmitted to the liquid crystal unit 200 with a period identical to the Vcom signal and to remove conventional flickers.

Next, the liquid crystal unit 200 transmits or blocks the light according to a voltage difference between an electrode 350 for receiving the still mode image signals and the third power GND so as to display still images. At this time, in the still mode operation, the scan driver 20 and the source driver 30 of FIG. 2 are disabled until switching to the operation mode. Since no signal is provided to the scan signal lines and source signal lines, and the image information is stored in the pixel according to the operation of the memory cell unit 300, the power consumed by the LCD panel is greatly reduced until switching to the operation mode.

In the above, since the second control signal transmitted to the level shift unit 400 via the second control signal line 23 is in low state, and the output voltage of the level shift unit 400 is in high state, the still nTFT N7 is turned on, but in the case the output voltage of the level shift unit 400 is identical with that of the still mode image signal, the voltage of the still mode image signal transmitted to the liquid crystal unit 200 via the still nTFT N7 is lowered by as much as the unique threshold voltage of the still nTFT N7. In order to prevent this, the voltage is increased to that of the second power VD2 voltage by the level shift unit 400 and supplied to the gate electrode 410 of the still nTFT N7. That is, as shown in FIG. 4, for example, in the operation of the level shift unit 400, when the second control signal is in low state, the output voltage of the third inverter circuit P5 and N8 becomes high, and this high state voltage is the voltage of the second power VD2 greater than that of the still mode image signal and supplied to the gate electrode 410 of the still nTFT N7.

Figure 5:
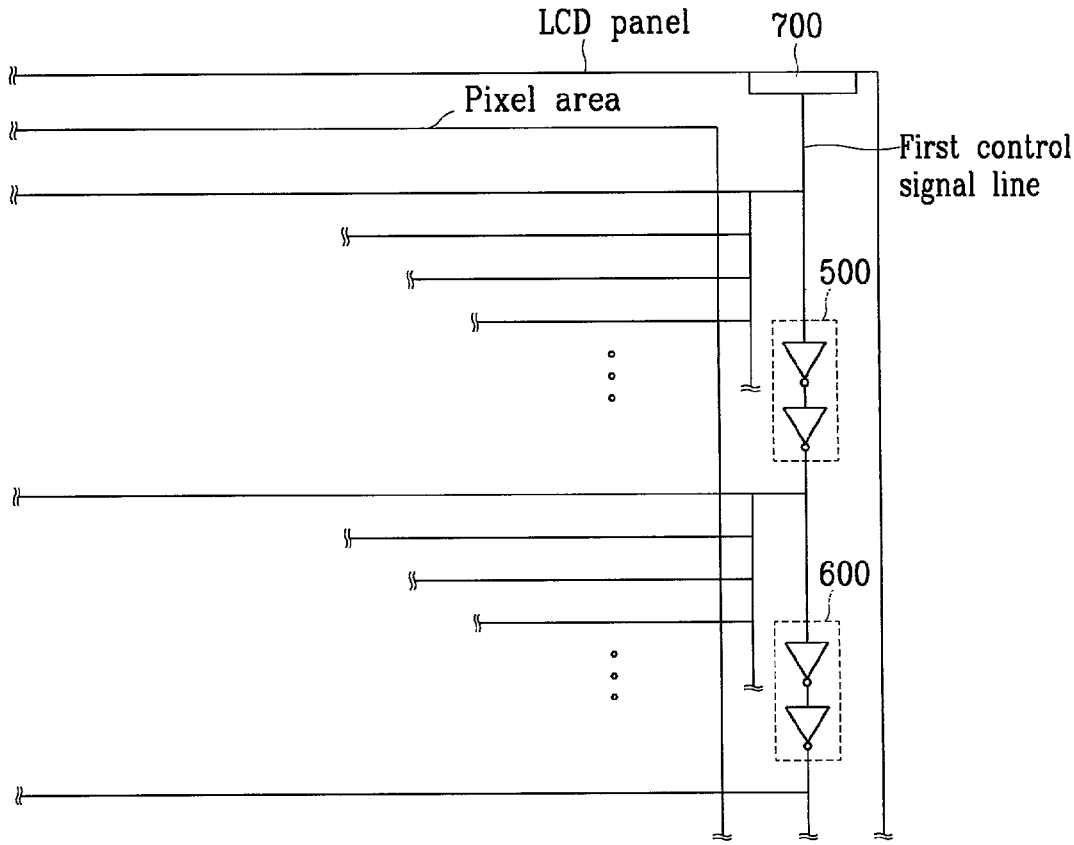
FIGS. 5 and 6 show methods for providing a first control signal to a pixel circuit configuring an LCD panel of the low power LCD driven as shown in FIGS. 3 and 4.
Figure 6:
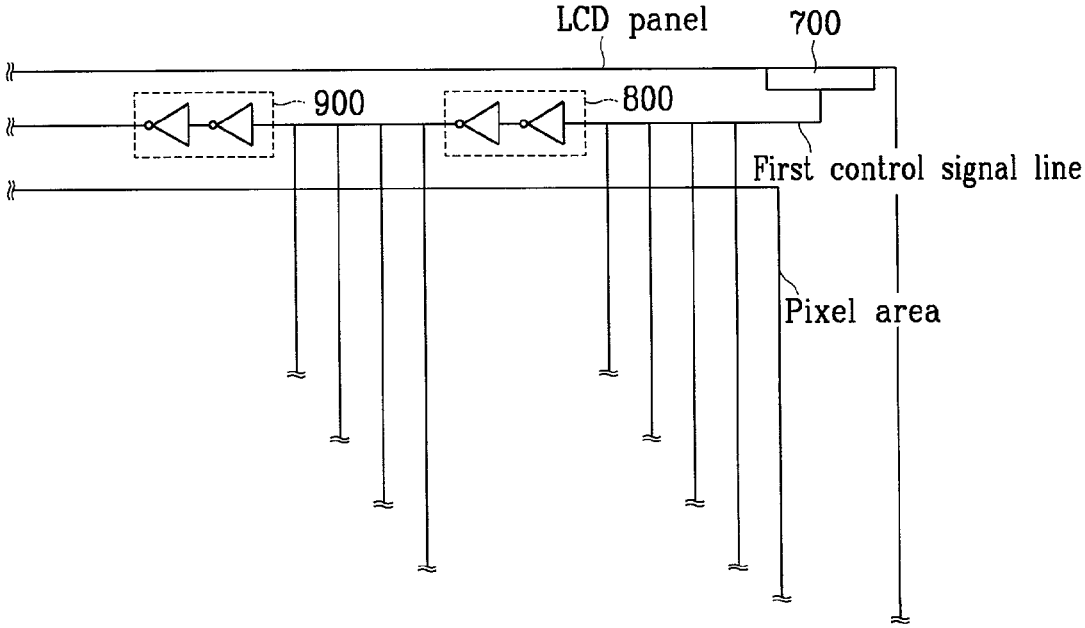

In the above, it is assumed that the powers VD1, VD2 and GND, the first and second control signals are generated by the timing controller provided on the main PCB 10 of FIG. 1 into appropriate DC power or pulse signals, and transmitted to the pixels via an input pad unit 700 on the LCD panel as shown in FIGS. 5 and 6.

Particularly, as shown in FIGS. 5 and 6, when the first control signal is sequentially delayed using buffer circuits 500 and 600, and provided to each pixel area divided into at least two portions in either the horizontal or vertical direction. Hence, the first control signal becomes high and the second control signal becomes low. That is, in the still mode operation, the power consumed by the inverter circuits P1, N5, P2 and N6 of the memory cell unit 100 and 300 is distributed according to time frames. Thus, the inverter circuits P1, N5, P2 and N6 provided in each pixel area divided into blocks are operated having time differences delayed by the buffer circuits 500 and 600. This can prevent signal distortions or panel deteriorations generated when the inverter circuits P1, N5, P2 and N6 consume the power at the same time.

Since the second control signal line 23 is connected to a plurality of TFT gates, the second control signal is sequentially delayed by the buffer circuits 500 and 600 to reduce load, and is supplied to the pixel area divided into at least two portions in either a horizontal or vertical direction.

As described above, in the normal operation mode, the second control signal transmitted via the second control signal line 23 is in high state and the first control signal transmitted via the first control signal line 22 is in low state, and the push nTFT N3, pull nTFT N4 and still pTFT P3 are turned off, and therefore, the memory cell unit 100 becomes floating from the powers VD1 and GND and is not operated, and the operation nTFT N2 becomes turned on, so the operation mode image signals transmitted to the third electrode 140 of the pixel switch are transmitted to the liquid crystal unit 200 to implement the moving pictures in full color. In the still mode operation, since the first control signal transmitted via the first control signal line 22 becomes high state and the push nTFT N3 and the pull nTFT N4 become turned on, the memory cell unit 100 receives the first and second powers VD1 and GND from the powers VD1 and GND and is then operated. As the second control signal transmitted via the second control signal line 23 periodically repeats the high and low states according to the characteristics of the LCD panel, the still pTFT P3 and the operation nTFT N2 periodically repeat on/off states according to the characteristics of the LCD panel, and then transmits either the still mode image signals transmitted to the third electrode of the pixel switch or corresponding inverting signals from the drain electrodes 111 generated by the first inverter circuit to the liquid crystal unit 200 so as to implement eight-color still images. Compared to the first preferred embodiment, the operation of the second preferred embodiment is identical to the first preferred embodiment except that the level shift unit 400 is added and the still nTFT N7 is substituted. At this time, in the still mode operation, since the memory cell units 100 and 300 store image information in the pixel, the power consumed by the LCD panel is greatly reduced until switching to the operation mode.

According to the preferred embodiments, the LCD is driven with eight colors in the still mode, and with full colors in the moving picture mode, and therefore, unnecessary image signal processing in the still mode and power waste caused by outputting the processed signals to the signal line of the LCD panel can be prevented. Accordingly, when the pixel configuration circuit according to the present invention is applied to the LCDs for notebook computers, PDAs and reflective PDAs, the user can drive them for a longer time when using a battery.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A liquid crystal display (LCD), comprising:

a scan signal line for supplying scanning signals to pixels configuring an LCD panel;

a source signal line for supplying image signals to pixels configuring the LCD panel;

a pixel switch for selectively providing the image signals to a third electrode from a first electrode connected to the source signal line depending on voltage state of a second electrode connected to the scan signal line;

a power unit for respectively supplying first power and second power to all pixels from outside of a pixel area of the LCD panel;

a control signal line unit including a first control signal line for transmitting a first control signal to all pixels from outside of the pixel area of the LCD panel, and a second control signal line for transmitting a second control signal to all pixels from the outside of the pixel area of the LCD panel;

a liquid crystal unit for selectively transmitting light according to voltage difference between the image signals and the second power; and a memory cell unit for receiving the first control signal and the second control signal from the control signal line unit.

2. The liquid crystal display (LCD) of claim 1, wherein the third electrode of the pixel switch outputs an operation mode image signal to the liquid crystal unit, when the first control signal is in low state and the second control signal is in high state.

3. The liquid crystal display (LCD) of claim 1, wherein the memory cell unit further comprises:

a first inverter circuit including a nTFT and a pTFT, a drain electrode of the nTFT is connected to the pTFT, and gate electrodes of the first inverter circuit are connected to the third electrode of the pixel switch;

a second inverter circuit including a nTFT and a pTFT, drain electrodes of the second inverter circuit are connected to the third electrode of the pixel switch, and gate electrodes of the second inverter circuit are connected to the drain electrodes of the first inverter circuit;

a push nTFT including a drain electrode connected to the first power, a source electrode connected to a source electrode of the pTFTs of the first and second inverter circuits and a gate electrode of the push nTFT connected to the first control signal line;

a pull nTFT including a source electrode connected to the second power, a drain electrode connected to source electrodes of the nTFTs of the first and second inverter circuit and a gate electrode of the pull nTFT connected to the first control signal line;

an operation nTFT including a gate electrode connected to the second control signal line, and source and drain electrodes of the operation nTFT are connected between the third electrode of the pixel switch and the liquid crystal unit; and a still pTFT including a gate electrode connected to the second control signal line, and source and drain electrodes of the still pTFT connected between the drain electrode of the first inverter circuit and the liquid crystal unit.

4. The liquid crystal display (LCD) of claim 1, wherein the pixel area of the LCD panel is divided into at least two portions and the control signal line transmits control signals sequentially delayed by a buffer circuit to corresponding pixel areas.

5. A low power liquid crystal display (LCD), comprising:

a scan signal line for supplying scanning signals to pixels configuring an LCD panel;

a source signal line for supplying image signals to pixels configuring the LCD panel;

a pixel switch for selectively outputting the image signals to a third electrode from a first electrode connected to the source signal line depending on voltage state of a second electrode connected to the scan signal line;

a power unit for supplying a first power, a second power and a third power to all pixels from outside of a pixel area of the LCD panel;

a control signal line unit including a first control signal line for transmitting a first control signal to all pixels from the outside of the pixel area of the LCD panel, and a second control signal line for transmitting a second control signal to all pixels from outside of the pixel area of the LCD panel;

a liquid crystal unit for selectively transmitting light according to a difference between the image signals and the third power; and a level shift unit for receiving the second control signal, lifting the high state by as much as the second power, generating an inverting signal, and outputting the inverting signal.

6. The liquid crystal display (LCD) of claim 5, further comprising a memory cell unit.

7. The liquid crystal display (LCD) of claim 6, wherein the memory cell unit receives the first and second control signals from the control signal line unit and receiving the inverting signal of the second control signal output by the level shift unit.

8. The liquid crystal display (LCD) of claim 7, wherein an operation mode image signal is selectively output by a third electrode of the pixel switch and the operation mode signal is selectively transmitted to the liquid crystal unit.

9. The liquid crystal display (LCD) of claim 7, wherein the memory cell unit comprises:

a first inverter circuit including a nTFT and a pTFT, a drain electrode of the nTFT connected to the pTFT, and gate electrodes of the first inverter circuit are connected to the third electrode of the pixel switch;

a second inverter circuit including a nTFT and a pTFT, drain electrodes of the nTFT and pTFT connected to the third electrode of the pixel switch, and gate electrodes of the second inverter circuit nTFT and pTFT are connected to the drain electrodes of the first inverter circuit;

a push nTFT including a drain electrode connected to the first power, a source electrode connected to source electrodes of the pTFTs of the first and second inverter circuits, and a gate electrode connected to the first control signal line;

a pull nTFT including a source electrode connected to the third power, a drain electrode connected to source electrodes of the nTFTs of the first and second inverter circuits and the second inverter circuit, and a gate electrode connected to the first control signal line;

an operation nTFT including a gate electrode connected to the second control signal line, and source and drain electrodes of the operation nTFT connected between the third electrode of the pixel switch and the liquid crystal unit; and a still nTFT having a gate electrode connected to receive an inverting signal of the second control signal output by the level shift unit, and source and drain electrodes of the still nTFT connected between the drain electrode of the first inverter circuit and the liquid crystal unit.

10. The liquid crystal display of (LCD) claim 7, wherein the third electrode of the pixel switch selectively outputs a still mode image signal.

11. The liquid crystal display of (LCD) claim 7, wherein the second control signal periodically repeats the low and high states according to characteristics of the LCD panel to selectively transmit an inverting signal to the liquid crystal unit.

12. The liquid crystal display (LCD) of claim 5, wherein the level shift unit comprises:

a third inverter circuit having an nTFT and a pTFT, a drain electrode of the nTFT is connected to that of the pTFT of the third inverter circuit, gate electrodes are connected to the second control signal line, a source electrode of the pTFT is connected to the second power, and a source electrode of the nTFT is connected to the third power; and a level-up pTFT having a gate electrode connected to a drain electrode of the third inverter circuit, a source electrode of the level-up pTFT is connected to the second power, and a drain electrode of the level-up pTFT is connected to the second control signal line.

13. The liquid crystal display (LCD) of claim 5, wherein the control signal line unit transmits respective control signals sequentially delayed by a buffer circuit to corresponding pixel areas when the pixel area of the LCD panel is divided into at least two portions.

14. A liquid crystal display (LCD) panel driving method for a pixel switch that receives scanning signals and image signals from scanning signal lines and source signal lines to output the image signals to a memory cell unit that is operated by first and second control signals or stops the image signals to display the same, an LCD driving method comprising:

the memory cell unit transmitting operation mode image signals output by the pixel switch to liquid crystal and displaying the same when the first control signal is in low state and the second control signal is in high state; and transmitting either a still mode image signal output by a third electrode of the pixel switch or its inverting signal to the liquid crystal as the second control signal periodically repeats low and high states to fit characteristics of an LCD panel when the first control signal is in high state.

15. The method of claim 14, wherein the pixel area of the LCD panel is divided into at least two portions in either a horizontal or vertical direction and respective control signals are transmitted and sequentially delayed by a buffer circuit to a corresponding pixel area.

16. A liquid crystal display (LCD), comprising:

a scan signal line;

a source signal line;

a pixel switch for selectively outputting image signals;

a power unit for supplying a first power, a second power and a third power to pixels;

a first control signal line for transmitting a first control signal to the pixels;

a second control signal line for transmitting a second control signal to the pixels; and a level shift unit in electrical communication with the second control signal for generating an inverting signal and increasing a voltage.

17. A liquid crystal display (LCD) of claim 16, wherein the level shift unit outputs the generated inverting signal.

18. A liquid crystal display, comprising:

a scan driver activated to supply scanning signals for a first period and inactivated for a second period;

a source driver activated to supply image signals for the first period and inactivated for the second period; and a plurality of pixels, each pixel including a liquid crystal capacitor displaying an image, a pixel switch for transmitting the image signals in response to the scanning signal, and a memory cell storing and transmitting the image signal from the pixel switch to the liquid crystal capacitor during the first period and providing at least one of the stored image signal and an inversion signal to the stored image signal for the liquid crystal capacitor during the second period.

* * * * *